United States Patent [19]

Draghicchio et al.

[11] 4,252,072

[45] Feb. 24, 1981

[54] DEVICE FOR FORMING A DOUBLE CHAIN STITCH IN A SEWING MACHINE

[75] Inventors: Pietro Draghicchio; Enrico Villa, both of Corsico, Italy

[73] Assignee: Rockwell-Rimoldi S.p.A., Milan, Italy

[21] Appl. No.: 45,905

[22] Filed: Jun. 6, 1979

[30] Foreign Application Priority Data

Jun. 7, 1978 [IT] Italy ..... 24284 A/78

[51] Int. Cl.[3] ..... D05B 1/06; D05B 1/10; D05B 57/00

[52] U.S. Cl. ..... 112/199

[58] Field of Search ..... 112/199, 197, 198, 165, 112/166

[56] References Cited

U.S. PATENT DOCUMENTS

| | | | |
|---|---|---|---|
| 2,029,242 | 1/1936 | Vesconte | 112/199 |
| 3,753,410 | 8/1973 | Kostenowczyk | 112/199 |
| 3,919,942 | 11/1975 | Galya et al. | 112/166 |

*Primary Examiner*—Ronald Feldbaum

[57] ABSTRACT

A device for forming double chain stitches in a sewing machine having independent thread sources for its needle and looper. The device includes a driving apparatus for causing travel of the looper solely in a rectilinear pathway in front of the needle and is effective in taking a loop of thread from the needle and to form a triangle of threads into which the needle will descend to effect completion of a stitch as the looper returns to its starting position.

3 Claims, 5 Drawing Figures

DEVICE FOR FORMING A DOUBLE CHAIN STITCH IN A SEWING MACHINE

BACKGROUND OF THE INVENTION

The present invention relates to a sewing machine of the double chain stitch type and more particularly pertains to the lower stitching instrumentalities thereof for forming such a stitch.

Sewing machines of this type, that are well known generally include at least one needle and cooperating looper with each having an independent thread source for the formation of seaming stitches. Such machines also include separate actuating mechanisms for the needle and looper. The one for the needle provides a means for moving the needle alternately in two senses along a rectinlinear path which is substantially vertical and perpendicular to the direction of the seam. The actuating mechanism for the looper provides a means for moving said looper along a substantially elliptical pathway which is arranged horizontally perpendicular with respect to both the axis of sewing and the pathway through which the needle travels. Additionally such machines also include conventional feeding means for advancing a workpiece through the sewing zone where the needle and looper elements perform their intended function. In known sewing machines of the type described above, the actuating means for the looper consists of two separate and similar mechanisms.

One of these mechanisms serves to provide the looper with an alternating to and fro movement which is perpendicular to the sewing axis and which substantially intersects the pathway through which the needle travels.

The other mechanism serves to provide the looper with an alternating to and fro movement which is parallel to the sewing axis and the combination of both movements causes the looper to travel in an elliptical pathway so that it will first grasp a loop of thread carried by the needle and then subsequently form a so-called "triangle of threads" into which the needle decends to effect the drawing of the looper thread through the loop of needle thread.

This mode of operation of the looper is well known to those conversant in the art and is effective in forming a double chain stitch of the type which is identified by numeral 401 in the United States Federal Standard Catalog. To form a stitch of the above described type with known devices of the prior art it is necessary that the looper also be caused to move in a direction parallel to the direction of the sewing axis in order to effect the formation of a triangle of threads which is formed by the looper itself, which forms its base, by the thread carried by the looper which is stretched between the ends thereof and the last stitch formed of the seam, as well as by the loop of thread taken from the needle that extends between the last stitch and the blade of the looper.

The latter two elements of thread form the sides of the triangle of threads with the vertex thereof being united with the workpiece so that the triangle lies extended in the direction in which said workpiece is caused to advance during the sewing cycle.

Displacement of the looper parallel to the direction of the sewing axis is provided in order to allow the looper to grasp the loop of needle thread as the needle is moving upwardly and, as is know, is located on that side of said needle at which the seam is being displaced. When the needle is raised the looper moves to a position which when said needle decends will be on the opposite side thereof and facilitates penetration of said needle into the triangle of threads during its downward travel.

SUMMARY OF THE INVENTION

An object of the present invention is that of simplifying sewing machines of the type described above, by eliminating that mechanism for effecting movement of the looper in a direction parallel with the sewing axis and to provide a new phasing between the needle and the looper which provides correct linking of the threads so as to form a seam of stitches of the double chain type.

To accomplish these objects the present invention provides a single mechanism for alternately displacing the looper in two senses along a retilinear pathway which is disposed, relative to the pathway of the needle, on that side of the latter opposite the side at which the triangle of threads is formed. The arrangement of each of these pathways is such that the needle is always located on the same side relative to the looper both during the stage of seizing of the loop of needle thread as well as during the stage of said needle's penetration into the triangle of threads.

The main advantage of using the new reciprocal arrangement of these pathways is that of eliminating the need of a compound movement of the looper in an elliptical pathway because the formation of the stitch can now be accomplished by causing the looper to travel solely in a rectilinear pathway.

Additionally the new reciprocal arrangement of these pathways does not restrict the side from which the movement of the looper towards the needle initiates, i.e. it can be from right to left or vice versa with respect to the direction of sewing since the choice of the side now depends exclusively on whether it is desired or not to employ a conventional production looper which is available for use in sewing machines of the known type.

According to the preferred embodiment utilized to show and describe the present invention, it will be noted that the hook starts its movement towards the needle from the left relative to the direction of stitching.

This choice requires the provision of a longer path for the thread which is carried by the looper, but by using a conventional type looper largely compensates for the slight disadvantage of the longer thread.

These and other objects of the present invention will become more fully apparent by reference to the appended claims and as the following detailed description proceeds in reference to the figures of drawing wherein:

DESCRIPTION OF THE PREFERRED EMBODIMENT

Figures 1, 5:
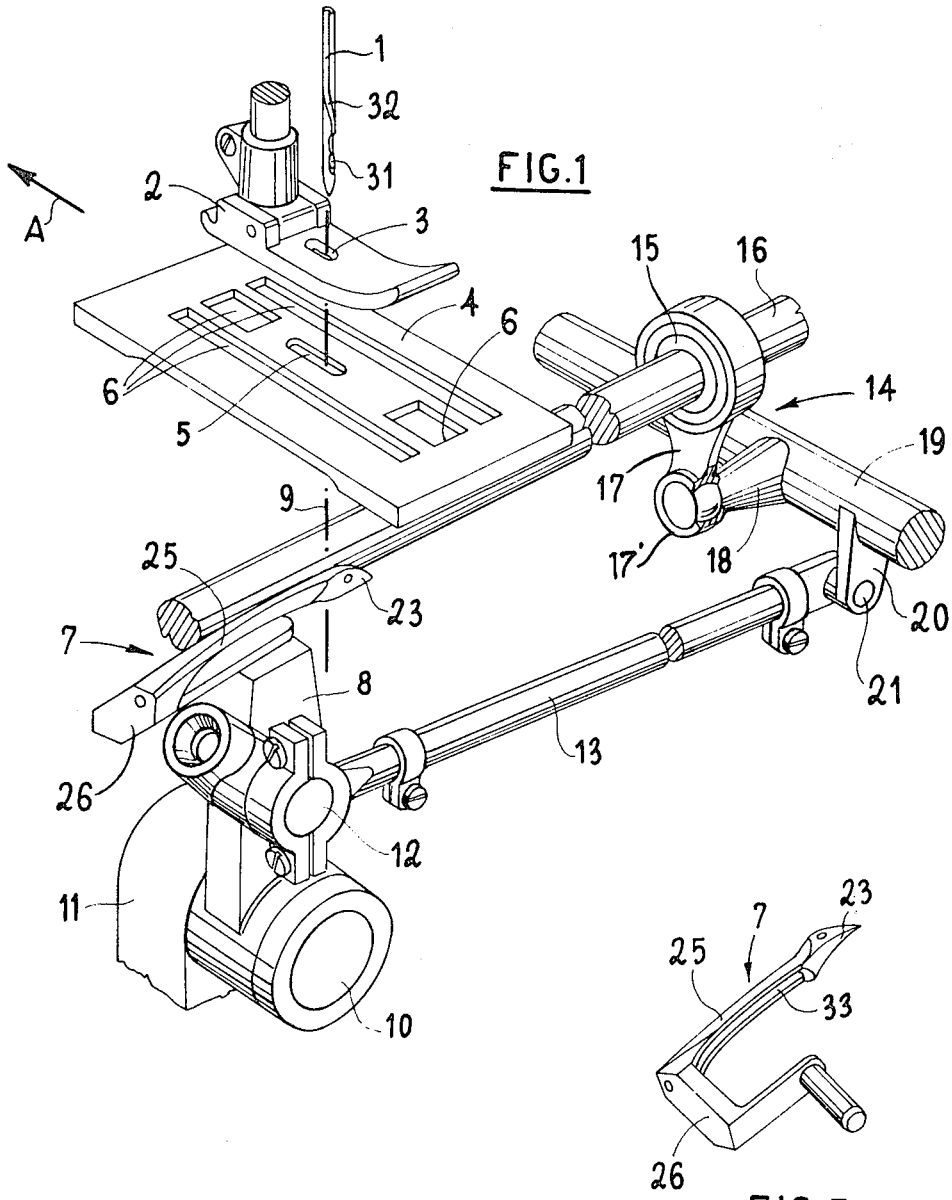
FIG. 1 is a perspective view of a portion of a sewing machine showing the device according to the invention applied thereto.
FIG. 5 is a perspective view of the looper showing the thread channel formed therein.
Figure 4:
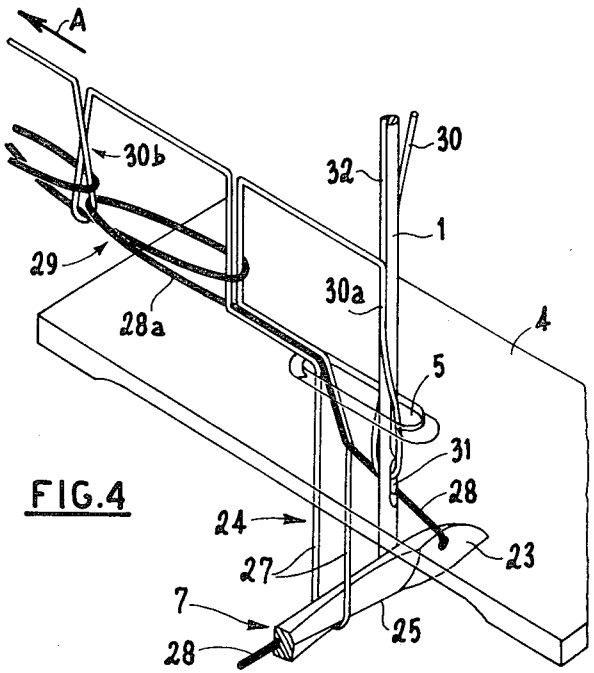
FIGS. 3 and 4 are similar views showing schematically and in perspective two opposite phases of cooperation between the looper and needle during the formation of a stitch.
Figure 3:
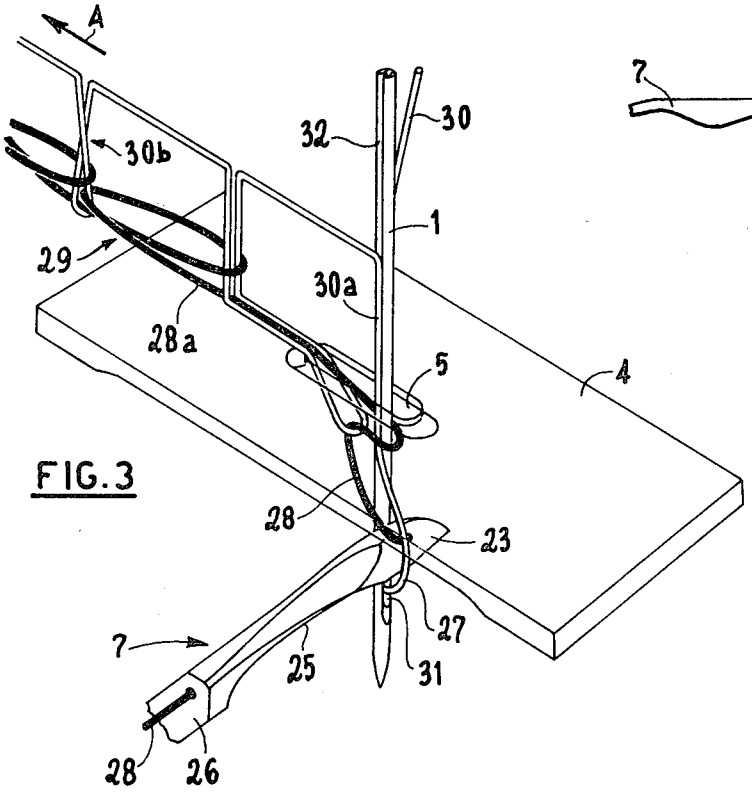

Now referring to the drawings enough of a sewing machine is shown in FIGS. 1, 3 and 4 to serve as a basis for a detailed description of the invention applied thereto. In FIG. 1 the sewing area is shown and among the various parts of the machine there is shown a needle 1 and a pressure foot 2 that includes the usual opening 3 through which said needle is caused to extend during the performance of its intended function. A needle plate 4 is located beneath the pressure foot and is provided with an opening 5 which also serves to permit passage of the needle 1. The needle plate is also provided with the usual series of openings identified by numeral 6 which in a known manner permit conventional feed dogs (not shown) to perform their function of advancing a workpiece (also not shown) along the sewing axis or that direction depicted by the indicating arrow A. Below the needle plate 4 the sewing machine is provided with a looper 7 mounted on a support 8 in such a way so as to be orientated perpendicular to the sewing axis and perpendicular to the vertical pathway 9 along which the needle 1 is caused to travel. This vertical pathway 9 extends through the two openings 3 and 5 provided in the presser foot and needle plate and intersects the sewing axis.

The support 8 is pivotably supported at its lower end by means of a pin 10 which assembles in a stationary part 11 of the sewing machine. This support 8 also includes a pivot pin 12 intermediate its ends which extends outwardly therefrom in a plane parallel with the sewing axis and is adapted to pivotably support one end of a driving rod 13 thereon. The opposite end of the driving rod 13 is operatively connected to a drive mechanism for the looper 7 and is identified generally by numeral 14.

This drive mechanism 14 includes a control eccentric 15 mounted on and for rotation with the main shaft 16 of the sewing machine. One end of a connecting rod 17 is assembled on the control eccentric 15 and its opposite end defines a universal ball joint 17' operatively connected to one end of an arm 18. The opposite end of this arm 18 is fixedly attached to a cross shaft 19 (FIG. 1) and through the connecting rod 17 the rotary movement of the main shaft 16 causes oscillating movement of said cross shaft.

The cross shaft 19 also includes an arm 20 fixed thereto which extends generally downward and with the lower end thereof being pivotally connected, by means of a pin 21, to that end of the driving rod 13 opposite its connection to the support 8. Through arm 20 the oscillating movement of cross shaft 19 causes reciprocating movement of the driving rod 13 and pivotable movement of the support 8 to effect to and fro travel of the looper 7 in a rectilinear pathway 22.

Figure 2:
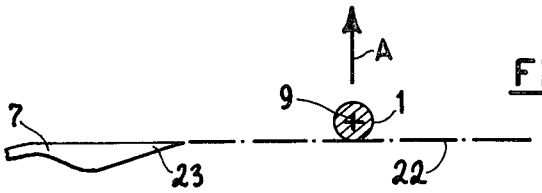
FIG. 2 is a schematic view showing the rectilinear pathway of the looper and its relationship to the needle.

During operation the needle 1 is caused to be alternately displaced in two senses along a vertical pathway 9 by a conventional drive means not shown, but which is operatively connected with the drive mechanism 14 for effecting actuation of the looper 7. The looper 7 is also alternately displaced in two senses along the rectilinear pathway 22 (FIG. 2) which extends generally perpendicular to the needle pathway 9 that is represented by a + sign in this figure of drawing.

The leading end or tip of the looper is identified by numeral 23 and the stitching cycle commences with said looper moving from left to right, as viewed in FIG. 3, so that it passes in close proximity with the needle 1. During this initial movement the tip 23 enters the loop of needle thread depicted by numeral 27 as the needle is moving upwardly in its pathway 9. During these movements of the looper and needle, the previously formed stitch is displaced in the direction of the indicating arrow A which applies tension to both the needle and looper threads so that as the looper reverses its direction of travel, the needle will decend into a triangle of threads 24 (FIG. 4) formed by the loop of needle thread taken by said looper during its initial movement and the looper thread itself depicted by numeral 28.

The formation of the triangle of threads 24 mentioned above is an essential part of the stitching cycle in sewing machines utilized for form stitches of the double chain type. The base of this triangle of threads is formed by a blade 25 which is that portion of the looper that extends from its tip 23 to its rear supporting structure identified by numeral 26. One side of the triangle is formed, as shown in FIG. 4, by the loop of needle thread 27 and the other side by the looper thread 28. The sides of this triangle form a vertex that is united with the previously formed stitch 29 so that said triangle is caused to extend in the direction of the indicating arrow A. To employ a single looper drive mechanism according to the invention it was necessary that the threading of the needle 1 be inverted relative to the direction of sewing, i.e. the needle thread 30 is threaded through the eye 31 of the needle from that side opposite to the side at which the looper travels in its rectilinear pathway 22. By threading the needle in this manner that portion of the needle thread identified by numeral **30*a* is located on the looper side of the needle which facilitates the formation of the loop 27 to be taken by the tip 23 of the looper 7**.

As a result of the relative positions which are established for the needle and looper, the latter travels along its rectilinear path both in a forwardly direction toward the needle as well as in a reverse direction away from said needle, and the latter during its travel is effective in penetrating the triangle of threads on each of its downward strokes.

The mode of operation of the looper is considered to be unique for to form double chain stitches prior to the instant invention it was necessary that the looper be caused to travel in an elliptical pathway which required that it be shifted from one side of the needle to the other. Although the present invention teaches travel of the looper solely in a rectilinear pathway, it is effective in linking the threads to form double chain stitches in a manner which corresponds to the known method of forming this type of stitch.

The sole variation with respect to the known form of stitch occurs in the vertical branches **30*b* of the needle thread 30 that are located within the workpiece and which are rotated by a half back turn due to the effect of the tension produced by the branch 28*a* of the looper thread 28** during the closing of a stitch which increases friction in the passage within the workpiece causing the stitch to be held to a greater extent.

For the purpose of assuring the correct location of the loop 27 of the needle thread 30 so that it will be taken by the looper at the front of needle 1, said needle is provided with two symmetrically helical grooves 32 which extend upwardly from the eye 31 on opposed sides of the needle and terminate in such a way that the portions of needle thread 30 contained therein are unable to interfere one with the other. The looper 7 was modified by providing it with a channel 33 through which the looper thread extends and is formed along the length of the underside of the blade 25 thereof. This channel 33 serves to prevent accidental needle interference with the looper thread as said needle is caused to move downwardly in its pathway to enter the triangle of threads. This channel 33 does not change the operating characteristics of the looper 7 so that it can be utilized in other sewing machines not having the looper actuating device of the present invention.

Although the operating position of the looper has been shown and described with its tip portion 23 pointed to the right as viewed in the various figures of drawings, it should be understood and obvious to those skilled in the art that the looper could perform the intended function of the invention if its tip portion 23 were arranged to face in the opposite direction. The direction in which the tip of the looper faces can actually be considered a matter of choice because the control eccentric 15 carried on the main shaft 16 must be rotated exactly 180° so as to maintain the necessary phasing between the needle and said looper for the correct formation of stitches.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. An apparatus for forming a double chain stitch in a sewing machine of the type having a needle plate with a sewing axis extending centrally along the longitudinal extent thereof and at least one needle being threaded from that side opposite to the side at which a looper travels in its rectilinear path having an independent thread source and reciprocally driven in a rectilinear pathway between positions above and below the needle plate, the improvement comprising:

(a) a looper having an independent thread source mounted for pivotal movement in the sewing machine beneath the needle plate including:

(i) a driving rod operatively associated with said looper; and (b) means for reciprocating said driving rod to effect movement of said looper solely in a rectilinear pathway forwardly of the needle and at right angles to the sewing axis for receiving a loop of thread carried by the needle and to form a triangle of threads into which the needle descends to effect formation of a stitch as said looper reverses its direction of travel in the rectilinear pathway.

2. The apparatus according to claim 1 wherein said looper has a U-shaped cross-sectional configuration intermediate its ends defining a channel through which the looper thread extends and which defines the base of the triangle of threads when formed by said looper.

3. The apparatus according to claim 1 wherein said reciprocating means includes (a) a cross shaft connected to said driving rod; and (b) a rotatably driven shaft including means interconnecting it with said cross shaft for effecting oscillating movement of the latter.

* * * * *